US008763868B2

(12) United States Patent
El Kadiri et al.

(10) Patent No.: US 8,763,868 B2
(45) Date of Patent: Jul. 1, 2014

(54) HINGED BRACELET

(71) Applicant: Montres Rado SA, Lengnau (CH)

(72) Inventors: Hakim El Kadiri, Saint-Blaise (CH); Sebastien Bolzt, Bienne (CH); Armin Guenster, Dotzigen (CH)

(73) Assignee: Montres Rado SA, Lengnau (CH)

( * ) Notice: Subject to any disclaimer, the term of this patent is extended or adjusted under 35 U.S.C. 154(b) by 0 days.

(21) Appl. No.: 13/775,508

(22) Filed: Feb. 25, 2013

(65) Prior Publication Data

US 2013/0221043 A1 Aug. 29, 2013

(30) Foreign Application Priority Data

Feb. 29, 2012 (EP) ..... 12157573

(51) Int. Cl.
*A44C 5/02* (2006.01)

(52) U.S. Cl.
CPC ..... *A44C 5/02* (2013.01)
USPC ..... 224/164; 368/282; 63/9

(58) Field of Classification Search
USPC ..... 224/164–179; 24/265 WS; 368/282; 63/3, 9
See application file for complete search history.

(56) References Cited

U.S. PATENT DOCUMENTS

| | | | | |
|---|---|---|---|---|
| 2,937,798 | A * | 5/1960 | Morf | 224/176 |
| 4,653,933 | A * | 3/1987 | Reichel | 368/282 |
| 2009/0238045 | A1 * | 9/2009 | Felton | 368/282 |

FOREIGN PATENT DOCUMENTS

| | | | | |
|---|---|---|---|---|
| CH | 702 308 | A2 | | 5/2011 |
| DE | 37 13 231 | A1 | | 10/1988 |
| EP | 1 287 758 | A1 | | 3/2003 |
| JP | 2000253613 | A | * | 9/2000 |
| JP | 2000253913 | A | * | 9/2000 |
| JP | 2009261873 | A | * | 11/2009 |

OTHER PUBLICATIONS

European Search Report issued Sep. 25, 2012, in European Patent Application No. 12157573.2, filed Feb. 29, 2012 with English Translation.

* cited by examiner

*Primary Examiner* — Justin Larson

(74) *Attorney, Agent, or Firm* — Oblon, Spivak, McClelland, Maier & Neustadt, L.L.P.

(57) ABSTRACT

A hinged bracelet (100) includes a first component (6) hinged with a second component (9) by a hinge (8) along an axis (D). A single-piece, resilient compensation element (1) is imprisoned between said first and second components (6; 9) to prevent any direct contact between said components radial to said axis (D), and to limit the relative angular travel thereof and includes, on either side of a central extensible layer (2), at a first end at least one first extensible and compressible boss (3), and at a second end at least one second extensible and compressible boss (4), said first boss (3) and said second boss (4) projecting relative to said layer (2) and having a larger section than that of said layer (2) in a plane perpendicular to said axis (D).

19 Claims, 6 Drawing Sheets

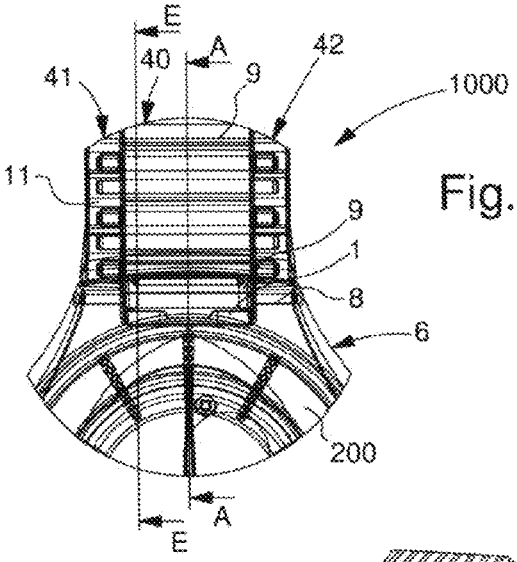
Fig. 9
Fig. 10
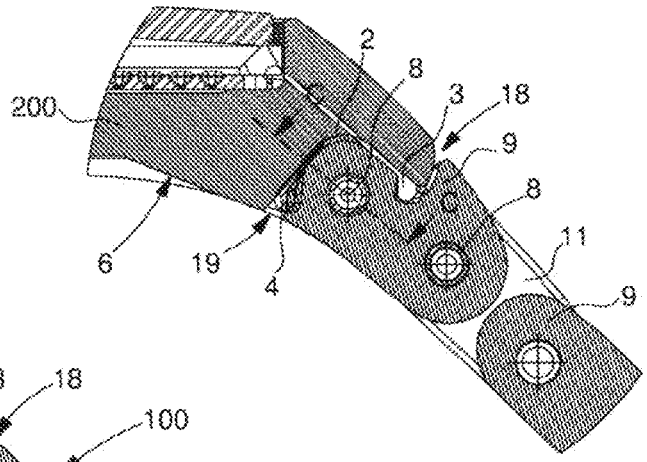
Fig. 11
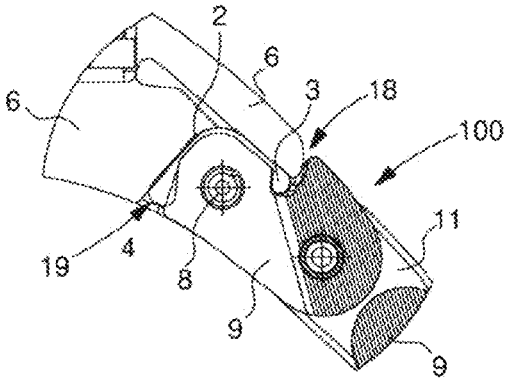
Fig. 12
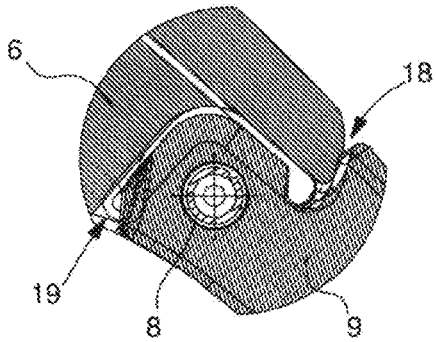

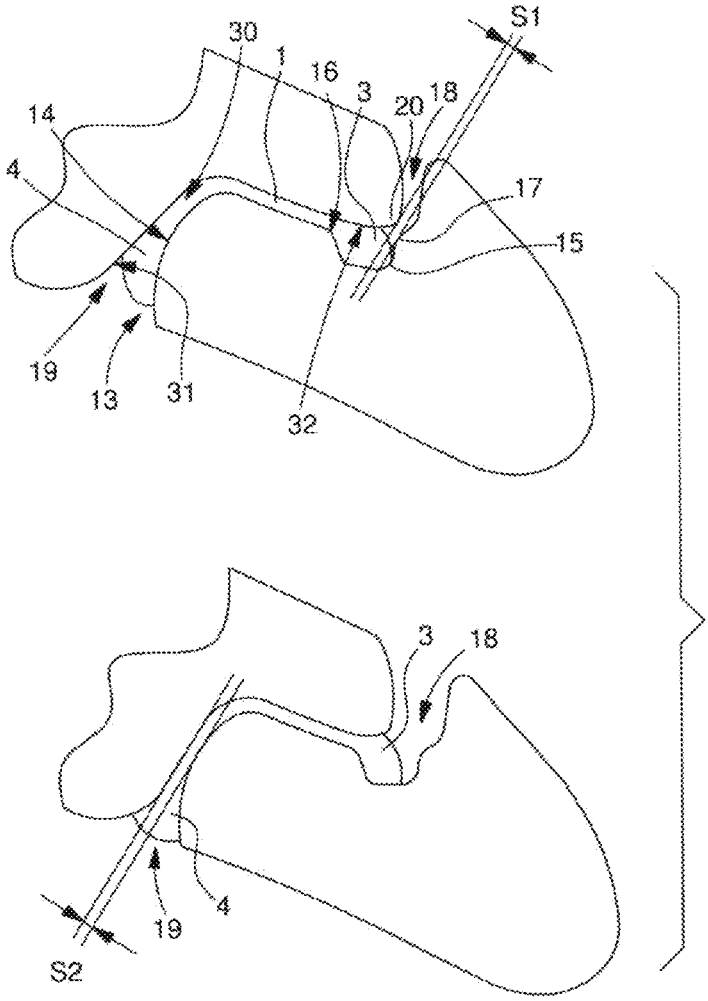
Fig. 15
Fig. 16
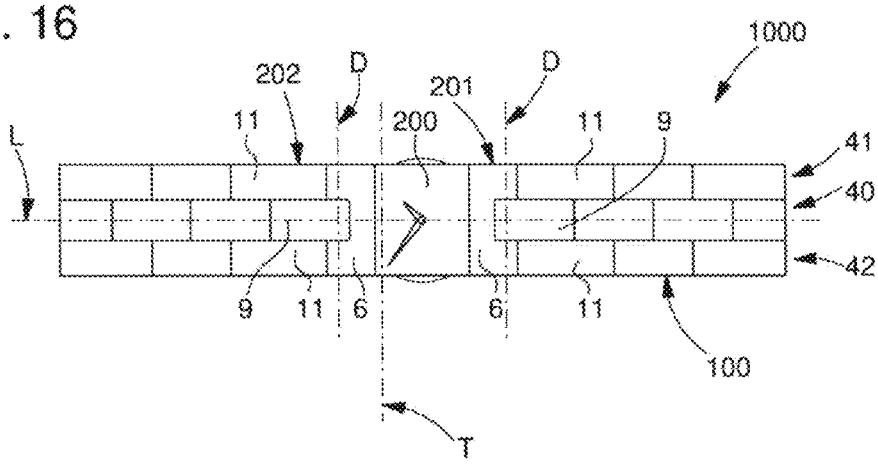

HINGED BRACELET

This application claims priority from European Patent Application No. 12157573.2 filed Feb. 29, 2012, the entire disclosure of which is incorporated herein by reference.

FIELD OF THE INVENTION

The invention concerns a compensation element for a watch, to be inserted between a first component and a second component secured to each other by a hinge along a pivot axis, to prevent any direct contact between said components in a direction radial to the hinge, and to limit the relative angular travel of said components with respect to said hinge.

The invention also concerns a structure for a watch, including at least one first component and at least one second component secured to each other by a hinge along a pivot axis.

The invention further concerns a hinged bracelet or wristlet including at least one first component hinged with at least one second component by a third hinge shaft component along a pivot axis.

The invention further concerns a watch including this type of hinged bracelet, and a watch case forming one said first component.

The invention concerns the fields of horology and jewelry and more particularly concerns hinged structures, such as bracelets, watch bracelets or wristbands, necklaces, chains or suchlike. These objects often include expensive and/or fragile components: watch cases, jewels or suchlike.

BACKGROUND OF THE INVENTION

These types of hinged structures, particularly bracelets and necklaces, often include expensive and/or fragile components: watch cases, jewels, or suchlike, which are sensitive to shocks and which it is important to protect.

It is known to insert damping links, made of rubber of similar, which are voluminous and unattractive, and which cannot easily be adapted to a pre-existing jewel structure It is consequently difficult to transform a piece of jewelry with a hinged structure in order to give it sufficient protection against shocks, while preventing the components thereof from hitting each other.

EP Patent Application No. 1 287 758 A1 in the name of SWATCH GROUP MAN SERV AG—RADO discloses a hollow link for a watch bracelet, including an element for mechanical coupling to other links or to the watch case using transverse pins. This component projects through an aperture in the link and is returned inside the link by a return spring after pinning. The issue is to improve the interface connection while protecting the fragile, antagonistic components (links, case, horns, decorative elements), particularly when they are made of ceramic, in a preferred implementation of the invention.

SUMMARY OF THE INVENTION

The invention proposes to provide a reliable solution for protecting this type of hinged structure, within a minimum space, with low production costs and by inserting components that are invisible to the user.

The invention therefore concerns a compensation element for a watch, to be inserted between a first component and a second component which are secured to each other by a hinge along a pivot axis, to prevent any direct contact between said components in a direction radial to said hinge, and to limit the relative angular travel of said components with respect to the hinge, characterized in that said compensation element is formed in a single piece made of resilient material, and includes, on either side of a central extensible layer, at a first end at least one first extensible and compressible boss, and at a second end at least one second extensible and compressible boss, said first boss and said second boss projecting relative to the layer and having a larger section than that of the layer in a plane perpendicular to a layer direction.

According to a feature of the invention, this compensation element 1 is adapted for the mutual protection of the links and/or structural elements of a hinged bracelet, said links and/or structural elements forming a said first component and a said second component hinged with each other by a third shaft component forming said hinge.

The invention further concerns a structure for a watch, including at least one first component and at least one second component secured to each other by a hinge along a pivot axis, characterized in that said structure includes, in proximity to said hinge, an intermediate space forming a chamber of substantially constant section parallel to said axis, and, on either side of said hinge and of said intermediate space, a first flared space and a second flared space which are divergent.

According to a feature of the invention, this structure is a hinged bracelet including at least one said first component hinged with at least one said second component via a third shaft component along a pivot axis, and said hinged bracelet includes, in proximity to said hinge shaft, said intermediate space forming a chamber of substantially constant section parallel to said axis, and, on either side of said hinge shaft and of said intermediate space, said first flared space and said second flared space which are divergent.

According to a feature of the invention, on either side of each said hinge shaft and of each said intermediate space, said hinged bracelet includes a first flared space and a second flared space which are divergent.

According to a feature of the invention, said hinged bracelet includes a compensation element of this type, imprisoned between said at least one first component and said at least one second component, in order to prevent any direct contact between said at least one first component and said at least one second component in a direction radial to said pivot axis, and to limit the relative angular travel, about said pivot axis, of said at least one first component with respect to said at least one second component.

According to a feature of the invention, said hinged bracelet includes a compensation element of this type whose geometry is adapted to that of said intermediate space to receive said layer and said flared spaces thereof to receive said at least one first boss and said at least one second boss thereof, so that said compensation element can be mounted taut at said layer, between said first and second bosses stopped by said flared spaces and imprisoned between said first component and said second component.

The invention further concerns a hinged bracelet including at least one first component hinged with at least one second component via a third hinge shaft component along a pivot axis, to which are attached a first transverse row of links formed of said second components and a second transverse row of links formed of said second components, on either side of said watch case, substantially parallel to said pivot axis and in each case imprisoning a compensation element of this type.

The invention further concerns a watch including a hinged bracelet of this type, and a watch case forming one said first component, characterized in that a first transverse row of links formed of said second components and a second transverse row of links formed of said second components are attached to said first component, on either side of said watch case, substantially parallel to said pivot axis and in each case imprisoning one said compensation element.

BRIEF DESCRIPTION OF THE DRAWINGS

Other features and advantages of the invention will appear more clearly upon reading the following detailed description, with reference to the annexed drawings, in which:

FIG. 9 shows a schematic, partial view of a hinged structure of a watch including a watch case and a hinged bracelet according to the invention, and FIGS. 10 and 11 are respectively cross-sections in planes A-A and E-E seen in FIG. 9, FIGS. 12 and 13 being enlarged views respectively of FIG. 10 and FIG. 11.

FIG. 15 illustrates the angular clearance of two adjacent components of the hinged structure in relation to each other, and the deformation of the compensation element which separates them during the change from one position to the other.

FIG. 16 is a schematic plan view of a hinged structure of a watch with the various rows of links of different types.

DETAILED DESCRIPTION OF PREFERRED EMBODIMENTS

Figure 1:
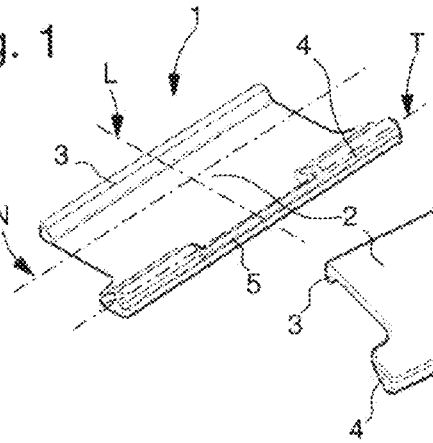
FIGS. 1 and 2 show schematic perspective views of the two main faces of a compensation element according to the invention.
Figure 2:
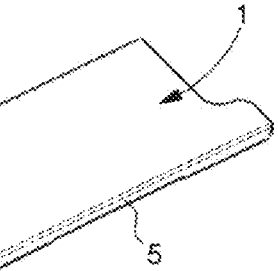
Figure 3:
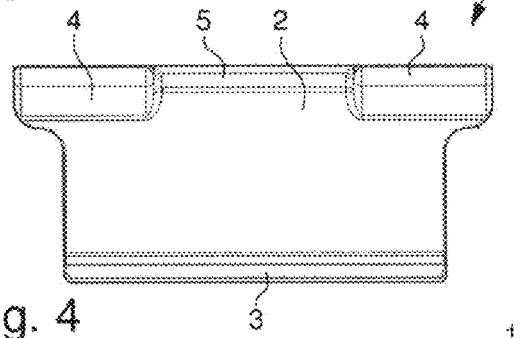
FIGS. 3 to 5 are the three conventional views of this same compensation element.
Figure 4:
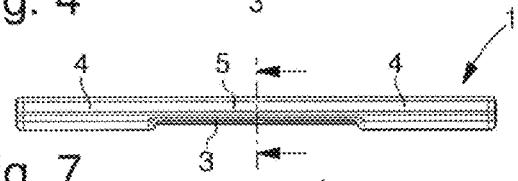

The invention concerns the fields of horology and jewelry and more particularly concerns hinged structures, such as bracelets, watch bracelets or wristbands, necklaces, chains or suchlike. These objects often include expensive and/or fragile components: watch cases, jewels or suchlike.

The invention proposes to damp any shocks between certain components, and more particularly between the component of the highest value, and the components to which it is attached, which are generally bracelet links. The damping according to the invention prevents high acceleration contact which is detrimental to fragile components, such as gems, crystals and certain ceramics, by the insertion of a compensation element in a suitable area. This compensation element is devised to prevent direct contact between two adjacent components, to damp their relative movement, to protect them and to limit noise when one component strikes or rubs against the other.

The invention therefore concerns a compensation element 1, preferably for a hinged bracelet. The application described here in detail is not restrictive, as the invention is applicable to other structures similar to bracelets.

In particular, the invention concerns a compensation element 1 for a watch 1000, to be inserted between a first component 6 and a second component 9 secured to each other via a hinge 8 along a pivot axis D, in order to prevent any direct contact between said components in a direction radial to said hinge 8, and to limit the relative angular travel of said components with respect to said hinge 8.

According to the invention, this compensation element 1 is formed in a single piece made of resilient material, and it includes, on either side of an extensible central layer 2, at a first end at least one first extensible and compressible boss 3 and at a second end, at least one second extensible and compressible boss 4, said first boss 3 and said second boss 4 projecting relative to layer 2 and having a larger section than that of layer 2 in a perpendicular plane to a layer direction N.

More particularly, this compensation element 1 is adapted for the mutual protection of links and/or structural elements of a hinged bracelet, said links and/or structural elements here forming one said first component 6 and one said second component 9 hinged with each other via a third shaft component 8 forming said hinge.

In a particular embodiment illustrated in the Figures, compensation element 1 is arranged to be inserted between a first component 6 and a second component 9, which are hinged with each other by a third hinge shaft component 8 along a pivot axis D. The purpose of this insertion is to prevent any direct contact between said two components 6 and 9 in a direction radial to the third hinge shaft component 8.

According to a preferred embodiment seen in the Figures, compensation element 1 also has the function of limiting the relative angular travel of said first component 6 and said second component 9 in relation to each other, with respect to the third hinge shaft component 8.

Preferably, compensation element 1 is formed of a single piece made of resilient material, rubber, elastomer, silicon or similar.

In a preferred embodiment of the invention, seen in FIGS. 1 to 8, compensation element 1 includes, on either side of an extensible central layer 2, at a first end at least one first extensible and compressible boss 3 and at a second end, at least one second extensible and compressible boss 4. In its rest state in the absence of stress, layer 2 extends in a layer direction N. The first boss 3 and second boss 4 project relative to layer 2 and have a larger section than that of layer 2 in a plane perpendicular to said layer direction N. Preferably, as illustrated in the Figures, each boss 3 or 4 also extends in this same layer direction N. They are therefore advantageously long and parallel to each other.

Bosses 3 and 4 are arranged to be wedged, at a distance from each other and preferably parallel to each other, in recesses comprised in certain components, or which are delimited by said adjacent components, in the joint and hinge area thereof. These bosses 3 and 4 act as both shock absorbers and angular travel limiters as regards the hinge. They are arranged to hold layer 2 in traction between the first component 6 and second component 9. Thus layer 2, in conjunction with bosses 3 and 4, prevents any direct contact between said two components.

Preferably, each at least one first boss 3 and each at least one second boss 4 is a prism section developed with generators parallel to the same transverse direction T.

Figure 5:
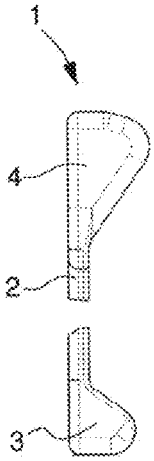
Figure 6:
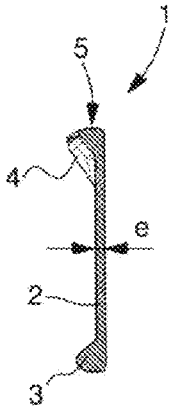
FIG. 6 is a cross-section thereof in a median plane visible in FIG. 4.
Figure 7:
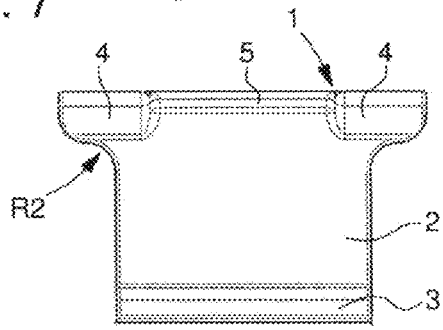
FIGS. 7 and 8 are top and end views of a variant of said compensation element.
Figure 8:
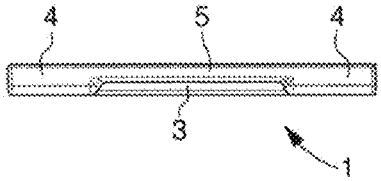
Figure 13:
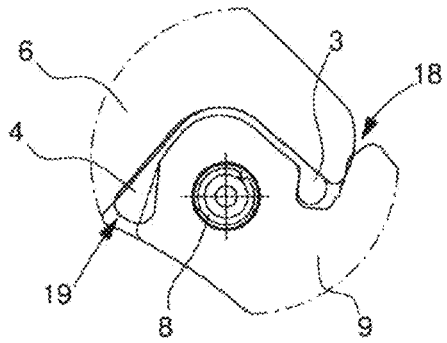
Figure 14:
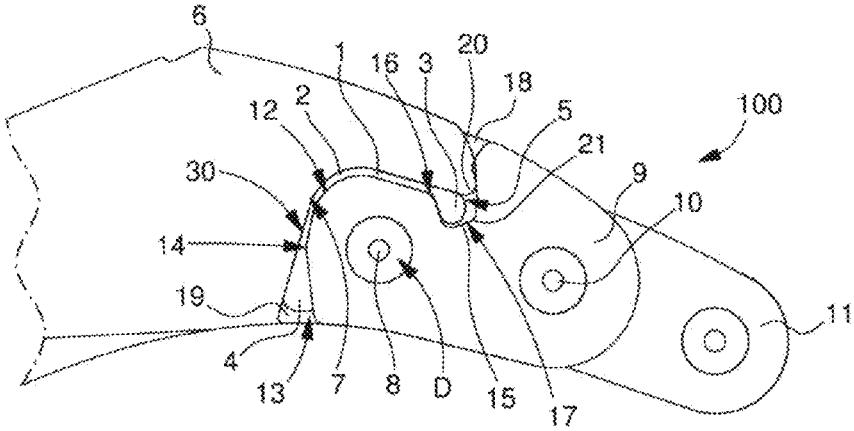
FIG. 14 is an off-centre cross-section showing, in the same view, the adherence to the hinged structure of bosses comprised in the compensation element of FIGS. 1 to 6, at both ends thereof.
Figure 17:
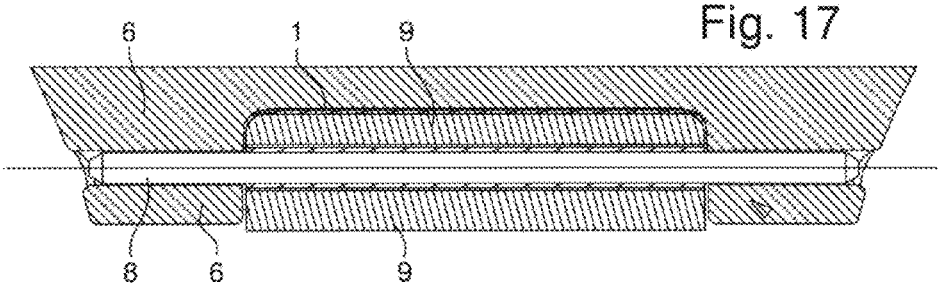
FIG. 17 is a cross-section along a plane C-C of FIG. 10
Figure 18:
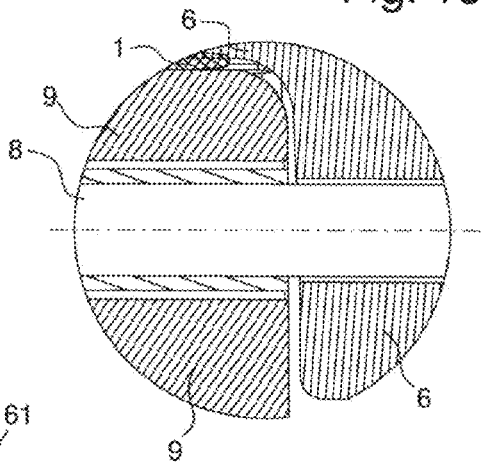
FIG. 18 is a detail of FIG. 17.
Figure 19:
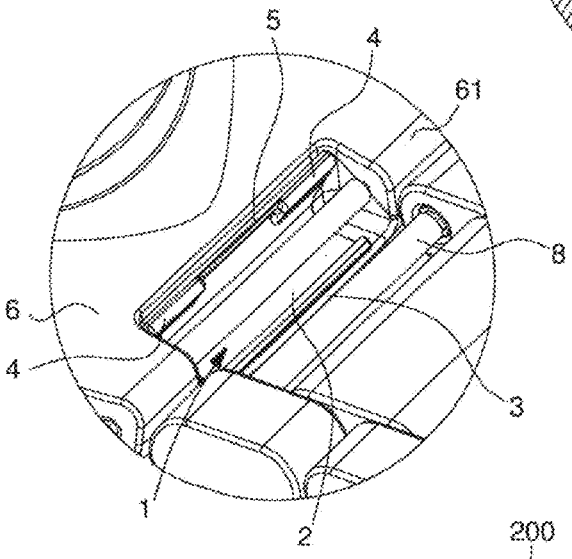
FIG. 19 is a schematic perspective diagram of the hinged structure of FIGS. 9 to 18 with the compensation element in place, a second component formed here by an axial link not being shown.

As seen in FIGS. 5 and 6, advantageously each at least one first boss 3 and each at least one second boss 4 is a prism section comprising, at the connection to central layer 2, which has parallel faces of constant thickness e on the largest surfaces thereof, a divergent dihedral profile, the smallest section of which is that of layer 2, preferably with an angle of between 30° and 60°.

In a particular embodiment, in projection onto a projective plane parallel to layer direction N, each at least one first boss 3 alternates with each at least one second boss 4, the projections thereof onto the projective plane being either partially superposed as in the Figures, or separated by a plane perpendicular to layer direction N in another variant which is not illustrated in the Figures.

Advantageously, compensation element 1 includes, at at least one of the ends thereof, a plurality of first bosses 3 and/or respectively a plurality of second bosses 4. FIGS. 1 to 8 illustrate an element 1 with a first single first boss 3 and two second bosses 4, which are developed partially on either side of the projection of first boss 3.

As will be seen below, this design with two bosses 4 instead of a single long boss avoids excessive local weakening of the receiving components of compensation element 1 according to the invention.

Advantageously, these two second bosses 4 are connected to each other by a lip 5, which is preferably also a prism section developed with generators parallel to the same layer direction N, and whose salient relative to layer 2 is less than that of the first boss or bosses 3 and to that of the second bosses 4. This lip 5 gives element 1 some rigidity in direction N and makes it easier to hold the two bosses 4 in alignment during the assembly of element 1.

Preferably, as seen in FIG. 6, this lip 5 has a divergent profile, preferably homothetic to or merged with that of second bosses 4.

The connecting area between layer 2 and second bosses 4 at the periphery of layer 2 is advantageously provided with radii R2 to prevent any tearing, which are sized to be two or three times the thickness e of layer 2.

Indeed, for easy, discreet insertion into a hinged structure of this type, in particular into a pre-existing hinged structure, the dimensions of insert element 1 are reduced as much as possible, in particular as regards thickness e of layer 2, which is preferably less than 0.20 mm, whereas bosses 3 and 4 are salients with values of up to 1.0 mm.

The invention further concerns a structure 100 for a watch 1000, including at least one first component 6 and at least one second component 9 secured to each other by a hinge 8 along a pivot axis D. According to the invention, this structure 100 includes, in proximity to hinge 8, an intermediate space 30 forming a chamber of substantially constant section parallel to said axis D, and on either side of said hinge 8 and of said intermediate space 30, a first flared space 18 and a second flared space 19 which are divergent.

In the particular embodiment illustrated in the Figures, structure 100 is a hinged bracelet 100 including at least one said first component 6 hinged with at least one second component 9 via a third hinge shaft component 8 along a pivot axis D, and said hinged bracelet 100 includes, in proximity to said hinge shaft 8, said intermediate space 30 forming a chamber of substantially constant section parallel to axis D and, on either side of hinge shaft 8 and of intermediate space 30, the first flared space 18 and the second flared space 19 which are divergent. Preferably, when the first component 6 is hinged, on two sides, each time with a second component 9 via a third hinge shaft component 8, there is an intermediate space on each side of first component 6 surrounded each time by said flared spaces.

Preferably, when bracelet 100 includes a plurality of hinges 8 between fragile components, made of ceramic, glass, amorphous metal or suchlike, each of these hinge areas 8 is arranged in accordance with the invention.

In a preferred embodiment, this hinged bracelet 100 includes a compensation element 1, inserted and imprisoned between said at least one first component 6 and said at least one second component 9, to prevent any direct contact between said components in a direction radial to hinge 8, and for limiting the relative angular travel thereof with respect to hinge 8, said compensation element 1 being formed in a single piece made of resilient material, and comprising, on either side of an extensible central layer 2, at a first end at least one first extensible and compressible boss 3 and at a second end at least one second extensible and compressible boss 4, said first boss and said second boss 4 projecting relative to said layer 2 and having a larger section than that of layer 2 in a plane perpendicular to a layer direction N. The compensation element 1 is mounted so that the layer direction N thereof is parallel to pivot axis D. Hereafter, this common direction will be called the "transverse direction T" while the direction perpendicular thereto, along which series of hinged links generally develop, will be called "longitudinal direction L".

In a particular embodiment, each first component 6 is a ceramic link and each second component 9 is a ceramic bracelet link. Or, in the most common case, one of the first components 6 is formed by a watch case 200, flanked by two second components 9, bracelet 100 being then formed of a series of hinged links alternately formed of first link components 6 and second link components 9.

Although, as mentioned above, an existing bracelet can be fitted with a compensation element 1 according to the invention, dynamic interference makes it difficult for bosses 3 and 4 to be given a large size. Also, positioning simply in hollows formed by hinge areas is often insufficient to properly hold a compensation element 1, which then resembles a flat joint, poorly held in traction.

Therefore, the hinged bracelet 100 includes at least the first component 6 or the second component 9 specifically arranged to receive one or other of bosses 3 and 4, or both of said bosses 3 and 4, and preferably both the first component 6 and the second component 9 have a geometry devised to perfectly hold compensation element 1 according to the invention, whatever the angular position between said two components 6 and 9.

FIGS. 9 and 16 illustrate a timepiece 1000, and in particular a watch, with a hinged bracelet 100 which includes a first component 6 comprising a watch case 200, or formed by a watch case 200, hinged at least with second components 9 which form part here of a central longitudinal row 40, via hinge pins 8 with pivot axes D.

Hinged bracelet 100 includes, in proximity to each hinge pin 8, an intermediate space 30 forming a chamber of substantially constant section, parallel to direction D, for receiving a layer 2 of a compensation element 1 according to the invention, and, on either side of each hinge pin 8 and of said intermediate space 30, a first divergent flared space 18 for housing at least one boss 3 of the same element 1 and a second divergent flared space 19 for housing at least one second boss 4 of the same element 1.

Preferably, hinged bracelet 100 includes a compensation element 1 whose geometry is adapted to that of intermediate space 30 and of flared spaces 18 and 19, so that compensation element 1 can be assembled taut at the layer 2 thereof, between bosses 3 and 4 stopped by flared spaces 18 and 19 and imprisoned between the first component 6 and second component 9.

Figure 20:
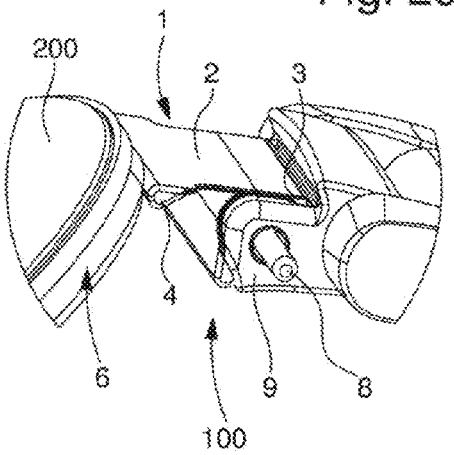
FIG. 20 is a similar view, seen from the opposite side, where said link is visible, whereas the end of the first component, which is integral with a watch case here, is not shown.
Figure 21:
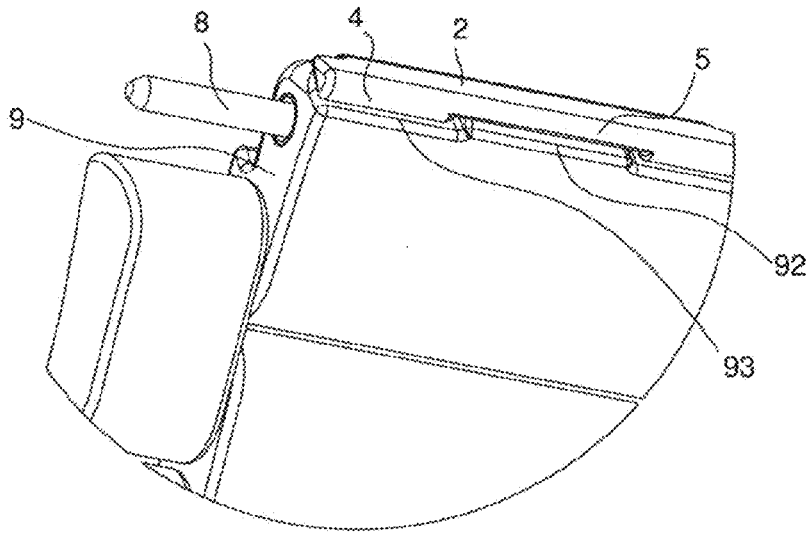
FIGS. 21 and 22 illustrate, in schematic, partial and perspective views, how the compensation element is held on said second component.

It is therefore possible to completely confine compensation element 1 between first component 6 and second component 9, stopped by the various bosses in cooperation with the profile of said components, which, in some cases, allows compensation element 1 to be secured without bonding, when the constituent material thereof does not permit bonding. When permitted by the material of element 1, bonding on one of the antagonistic components facilitates the positioning of said element, as seen for example in FIG. 20.

In a preferred, non-limiting example of the invention, this hinged bracelet 100 includes at least one first component 6 which, about pivot axis D, has a concave profile 7 substantially homothetic to a convex profile 12 of the second component 9 facing concave profile 7, so as to delimit therewith an intermediate space 30 for housing layer 2. This intermediate space 30 is bordered on both sides, around pivot axis D, by a first flared space 18 for housing the first boss 3, and by a second flared space 19 for housing the second boss 4.

In an advantageous variant, seen in FIGS. 11 to 15, to delimit the first flared space 18 and/or the second flared space 19, the first component 6 and/or second component 9 has, either a radius of abutment 14 followed, moving away from intermediate space 30, by a rounded ramp 13, or a radius of abutment 16 followed, moving away from intermediate space 30, by a groove 15 delimited by a stopping radius 17.

In particular, on one side of convex profile 12, the second component 9 has a radius of abutment 14 followed, moving away from intermediate space 30, by a rounded ramp 13, and on the other side of convex profile 12, a radius of abutment 16 followed, moving away from intermediate space 30, by a groove 15 delimited by a stopping radius 17. Further, this first component 6 has, opposite rounded ramp 13, a first rounded ramp 14 which remains at a distance from rounded ramp 13 in any position of compression or traction of compensation element 1 and includes, opposite groove 15, a second rounded ramp 32 delimited by a beak 20 facing stopping radius 17 and remaining at a distance from stopping radius 17 in any position of compression or traction of compensation element 1. FIG. 15 illustrates the deformation of compensation element 1 in two relative angular extreme positions between first component 6 and second component 9.

In a particular case, the first flared space 18 and second flared space 19 are located on either side of a plane perpendicular to pivot axis D.

Generally, when compensation element 1 adopts a T-shape, as in FIGS. 1 to 8, with two second bosses 4 at least partially on either side, in layer direction N, of first boss 3, the first flared space 18 and the second flared space 19 are not in the extension of each other, as is seen in FIGS. 9, 10 and 11, the first flared space 18 being arranged in cross-section AA, which forms a plane of symmetry in this particular case, and each second flared space 19 being in a cross-section EE parallel to and offset in relation to said cross-section AA.

Preferably, compensation element 1 includes at least one lip 5 and this lip 5 closes the first flared space 18 and/or second flared space 19, in which it is located, in any position of compression or traction of compensation element 1.

Preferably, as seen in the Figures, the first component 6 includes at least one fork cooperating with a plurality of axial 9 and lateral 11 second components arranged in a quincunx with lateral longitudinal rows 41, 42 on either side of an axial longitudinal row 40 and compensation element 1 only develops along axial row 40 formed by second links 9, without any contact with the second lateral links 11 of lateral rows 41 and 42.

Figure 22:
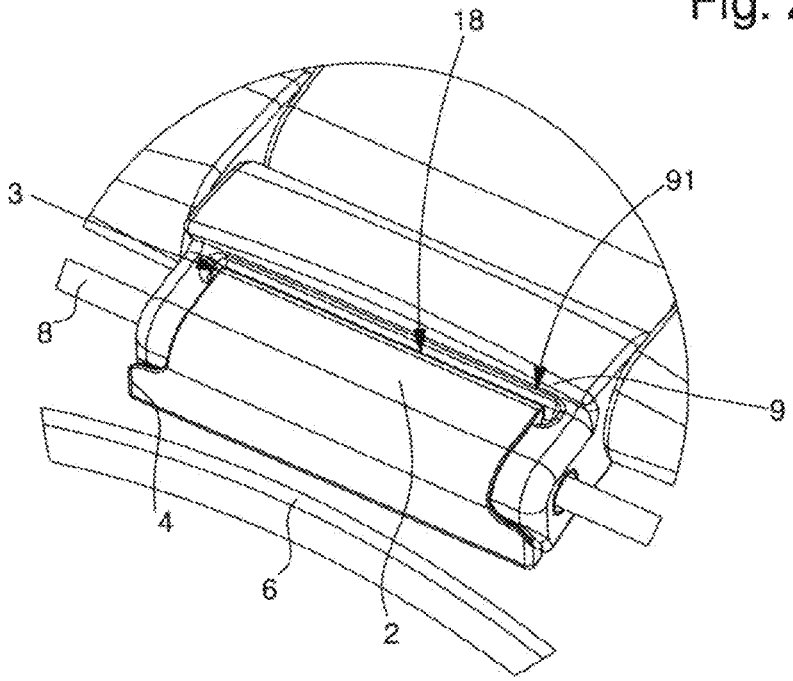

Advantageously, as seen in FIG. 22, compensation element 1 is housed in a transverse groove 91, which includes the first flared space 18 and which is not as wide as the link forming the second axial component 9, so as not to weaken the latter. This arrangement, which ensures the rigidity of the link, explains the T-shape of compensation element 1. On the opposite side, there is preferably no groove, it is the profile of the edge of second link 9 which, in conjunction with the profile of first link 6, delimits the second flared space 19, and consequently bosses 4 can occupy the whole of the width of link 9. By restricting the width of compensation element 1, preferably made in the form of a joint, to the width of second component 9, it is possible to completely conceal, over all the visible faces of the piece of jewelry or timepiece, the presence of compensation element 1, which is only visible on a bottom surface facing the user's skin. In particular, a beak 20, seen in FIGS. 14 and 15, permanently protects and conceals joint 1.

Using the arrangement with two separate bosses 4, it is possible to make a link boss 92 between two recesses 93, which is advantageous for the making of the link, and allows a very good transverse hold of compensation element 1 with no risk of sliding caused by friction.

In a particular embodiment (not illustrated), the first component 6 has at least one fork cooperating with a plurality of second axial 9 and lateral 11 components arranged in a quincunx, and compensation element 1 has at least one first boss 3 aligned with each second axial component 9 and at least one second boss 4 aligned with each second lateral component 11.

In another particular embodiment (not illustrated), the first component 6 has a fork cooperating with a second axial component 9 laterally flanked by two second lateral components 11 and compensation element 1 has a first boss 3 aligned with the second axial component 9, and two second bosses 4 each aligned with the same second axial component 9 with which the first boss 3 is aligned.

In another particular embodiment, the first component 6 has a fork cooperating with a second component of a first type 9 laterally flanked by two second lateral components 11 and compensation element 1 has a first boss 3 aligned with the second axial component 9, and two second bosses 4 each aligned with a second lateral component 11, and the two second bosses 4 are connected by a lip 5 parallel to pivot axis D, and whose salient relative to layer 2 is less than that of the two second bosses 4.

In a particular embodiment, the hinged bracelet 100 includes a plurality of axial links 9 and/or lateral links 11, all connected to each other and/or to a first component 6 in each case by at least one compensation element 1 according to the invention.

In a preferred application of the invention, first component 6 is a watch case 200 and each second component 9 is a ceramic bracelet link. In this configuration, the invention is very advantageous when watch case 200 is also made of ceramic.

The invention also concerns a watch 1000 including a hinged bracelet 100 of this type and a watch case 200 forming a first component 6 to which there are attached, on either side of watch case 200, in each case imprisoning a compensation element 1 and substantially parallel to pivot axis D, a first transverse row 201 of links formed of second axial components 9 and/or lateral components 11 and a second transverse row 202 of links formed of second axial components 9 and/or lateral components 11.

The invention thus improves the interface connection while protecting the fragile, antagonistic components (links, case, horns, decorative elements), particularly when they are made of ceramic, in a preferred implementation of the invention.

More generally, this type of compensation element 1 can be used as an insert between two hard bodies.

It is particularly suitable when at least one of the antagonistic components is made of ceramic, while the other may be made of ceramic, metal, sapphire, amorphous metal or other hard material. Thus the invention concerns both external elements or decorative elements and the structural elements for which it was primarily devised, in a non-limiting application for the case of the bracelet described here.

The invention claimed is:

1. A compensation element for a watch, to be inserted between a first component and a second component which are secured to each other by a hinge along a pivot axis, to prevent any direct contact between said components in a direction radial to said hinge, and to limit the relative angular travel of said components with respect to said hinge, wherein said compensation element is formed in a single piece made of resilient material, and includes, on either side of a central extensible layer, at a first end at least one first extensible and compressible boss, and at a second end at least one second extensible and compressible boss, said first boss and said second boss projecting relative to said layer and having a larger section than that of said layer in a plane perpendicular to a layer direction.

2. The compensation element according to claim 1, wherein said element is adapted for the mutual protection of at least one of links and structural elements of a hinged bracelet, said at least one of links and structural elements forming one said first component and one said second component hinged to each other via a third shaft component forming said hinge.

3. The compensation element according to claim 2, wherein each said at least one first boss and each said at least one second boss is a prism section developed with generators parallel to the same transverse direction.

4. The compensation element according to claim 3, wherein each said at least one first boss and each said at least one second boss is a prism section including, at the connection to said central layer which has parallel surfaces of constant thickness, a divergent dihedral profile the smallest section of which is that of said layer.

5. The compensation element according to claim 1, wherein said element includes at least one of a plurality of said at least one first bosses and respectively a plurality of said at least one second bosses, which are connected to each other by a lip, which is a prism section developed with generators parallel to the same transverse direction and whose salient relative to said layer is smaller than that of said first bosses, respectively seconds bosses.

6. A structure for a watch, comprising:

at least one first component and at least one second component secured to each other by a hinge along a pivot axis, a compensation element inserted and imprisoned between said at least one first component and said at least one second component, said compensation element being formed in a single piece made of resilient material, and including, on either side of a central extensible layer, at a first end at least one first extensible and compressible boss, and at a second end at least one second extensible and compressible boss, wherein said structure includes, in proximity to said hinge, an intermediate space forming a chamber of substantially constant section parallel to said axis, and, on either side of said hinge and of said intermediate space, a first flared space and a second flared space which are divergent.

7. The structure according to claim 6, wherein said structure is a hinged bracelet including at least one said first component hinged with at least one said second component via a third hinge shaft component along a pivot axis, and wherein said hinged bracelet includes, in proximity to said hinge shaft, said intermediate space forming a chamber of substantially constant section parallel to said axis, and, on either side of said hinge shaft and of said intermediate space, said first flared space and said second flared space which are divergent.

8. The hinged bracelet according to claim 7, wherein said bracelet includes the compensation element inserted and imprisoned between said at least one first component and said at least one second component, to prevent any direct contact between said components in a direction radial to said hinge, and to limit the relative angular travel of said components with respect to said hinge, said first boss and said second boss projecting relative to said layer and having a larger section than that of said layer in a plane perpendicular to a layer direction.

9. The hinged bracelet according to claim 8, wherein said bracelet includes one of said compensation element, whose geometry is adapted to that of said intermediate space to receive said layer and said flared spaces thereof to receive said at least one first boss and said at least one second boss thereof, so that said compensation element can be mounted taut at said layer, between said first and second bosses stopped by said flared spaces and imprisoned between said first component and said second component.

10. The hinged bracelet according to claim 8, wherein said at least one first component includes, about said pivot axis, a concave profile substantially homothetic to a convex profile of said at least one second component facing said concave profile so as to delimit therewith one said intermediate space for housing said layer, said intermediate space being bordered on both sides, about said pivot axis, by a first flared space for housing said at least one first boss and by a second flared space for housing said at least one second boss.

11. The hinged bracelet according to claim 8, wherein, to delimit at least one of said first flared space and said second flared space, at least one of said first component and said second component includes, either an abutment radius followed, moving further away from said intermediate space, by a rounded ramp, or an abutment radius followed, moving further away from said intermediate space, by a groove delimited by a stopping radius.

12. The hinged bracelet according to claim 10, wherein said second component includes, on one side of said convex profile, one said abutment radius followed, moving further away from said intermediate space, by a rounded ramp, and on the other side of said convex profile, one said abutment radius followed, moving further away from said intermediate space, by a groove delimited by a stopping radius, and wherein said first component includes, facing said rounded ramp, a first rounded ramp which remains at a distance from said rounded ramp in any position of compression or traction of said compensation element, and, facing said groove, a second rounded ramp delimited by a beak facing said abutment radius and remaining at a distance from said abutment radius in any position of compression or traction of said compensation element.

13. The hinged bracelet according to claim 8, wherein said first flared space and said second flared space are located on either side of a plane perpendicular to said pivot axis.

14. The hinged bracelet according to claim 8, wherein said compensation element includes at least one lip between two said aligned second bosses comprised in said compensation element, and wherein said lip closes at least one of said first flared space and said second flared space in which said element is situated, in any position of compression or traction of said compensation element.

15. The hinged bracelet according to claim 8, wherein said bracelet includes a plurality of links, all connected to at least one of each other and to a first component in each case by at least one of the compensation element.

16. The hinged bracelet according to claim 8, wherein said first component is a watch case and wherein each said second component is a ceramic bracelet link.

17. The hinged bracelet according to claim 8, wherein each said first component is a ceramic link and wherein each said second component is a ceramic bracelet link.

18. The hinged bracelet according to claim 16, wherein said watch case is made of ceramic.

19. The watch including a hinged bracelet according to claim 8, and a watch case forming one said first component, wherein a first transverse row of links formed of said second components and a second transverse row of links formed of said second components and a second transverse row of links formed of said second components are attached to said first component, on either side of said watch case, substantially parallel to said pivot axis and in each case imprisoning one said compensation element.

* * * * *